United States Patent [19]

DeRouen

[11] Patent Number: 4,896,720

[45] Date of Patent: Jan. 30, 1990

[54] METHOD AND SYSTEM FOR CLEANING WELL CASING

[75] Inventor: Mark W. DeRouen, Carencro, La.

[73] Assignee: Atlantic Richfield Company, Los Angeles, Calif.

[21] Appl. No.: 286,915

[22] Filed: Dec. 20, 1988

[51] Int. Cl.[4] ..... E21B 37/04

[52] U.S. Cl. ..... 166/170; 15/104.061; 166/153; 166/177

[58] Field of Search ..... 166/170, 177, 153, 154, 166/155, 156, 192, 195, 291, 311, 312, 383, 289; 15/104.061, 104.2, 104.18

[56] References Cited

U.S. PATENT DOCUMENTS

| | | | |
|---|---|---|---|
| 1,392,105 | 9/1921 | Bergesen, Sr. | 15/104.061 |
| 1,598,771 | 9/1926 | Gerhardt | 15/104.061 |
| 1,713,895 | 5/1929 | Ford | 166/153 X |
| 2,392,144 | 1/1946 | Hall | 166/170 X |
| 2,447,966 | 8/1948 | Stephens | 166/170 X |
| 2,509,922 | 5/1950 | Hall | 166/153 |
| 2,567,475 | 9/1951 | Hall | 166/170 X |
| 3,541,628 | 11/1970 | Girard | 15/104.061 |
| 4,164,980 | 8/1979 | Duke | 166/291 |
| 4,345,350 | 8/1982 | Burd | 15/104.061 |
| 4,548,271 | 10/1985 | Keller | 166/291 |

FOREIGN PATENT DOCUMENTS

| | | | |
|---|---|---|---|
| 225145 | 6/1987 | European Pat. Off. | 166/153 |
| 727621 | 4/1955 | United Kingdom | 15/104.061 |

*Primary Examiner*—Hoang C. Dang
*Attorney, Agent, or Firm*—Michael E. Martin

[57] ABSTRACT

The inside wall surface of a wall casing or tubing string is cleaned by providing an apparatus including a resilient flanged plug member and an elongated body having plural helical wraps of wire bristles disposed on the exterior surface thereof for engagement with the casing wall to provide a scraping and cleaning action. The apparatus is typically employed to clean the interior of the casing concurrent with displacing a column of cement composition through the casing for use in cementing the casing in place in the wellbore.

4 Claims, 1 Drawing Sheet

METHOD AND SYSTEM FOR CLEANING WELL CASING

BACKGROUND OF THE INVENTION

1. Field of the Invention

The present invention pertains to a method for cleaning well casing and tubing strings to remove accumulated debris including drilling fluid, cement compositions, pipe joint compositions and other material prior to production of well fluids. A cleaning assembly including one or more resilient plugs and a spiral brush assembly is pumped or pushed down the casing or tubing during or upon completion of the cementing operation, for example.

2. Background

In conventional oil well completion operations, upon finishing the pumping down of a cement composition through the well casing or a tubing string inserted in the casing, a drilling rig is moved back over the wellhead or put back in operation to lower a tubing string on which a mechanical scraping device is disposed for cleaning the interior wall surface of the casing or the tubing string through which stimulation fluids or well production fluids will eventually flow. This cleaning operation is expensive and time consuming in that use of the drilling rig or similar equipment is required for lowering the tubing string on which the mechanical scraping mechanism is disposed. Moreover, removal from the wellbore of the debris or other material which has accumulated on the inside wall of the casing or tubing string is difficult to accomplish. Accordingly, there has been a longfelt need for a simpler method and system for cleaning well casing and similar tubing structures in wellbores to remove unwanted material from the interior of the casing before other well operations are conducted. The present invention is believed to fill such a need with an improved method and system or apparatus as described.

SUMMARY OF THE INVENTION

The present invention provides an improved method for cleaning the interior of a well casing or the like during completion of a well cementing operation and/or prior to the introduction of formation stimulation fluids through the casing or prior to the introduction of well production fluids into the casing from the formation.

In accordance with one aspect of the present invention, the improved method for cleaning a well casing includes the provision of an apparatus comprising one or more generally resilient plug members connected to one or more elongated bodies on which scraping brush bristles are disposed and which apparatus is adapted to be pumped or pushed down through the casing hydraulically or mechanically. In particular, the method may be carried out during the cementing operation to clean the casing wall of residual cement material, pipe joint composition and other debris remaining on the casing wall. The unique apparatus of the invention is adapted to remain in the well casing at a point below the formation interval of interest and the accumulated debris is preferably pumped into a section of casing extending below the interval of interest.

In accordance with another aspect of the present invention, a unique apparatus or system is provided for cleaning the interior of a well casing and the like comprising an assembly of one or more generally resilient plug members having peripheral flange portions which are engagable with the casing wall to provide a scraping action and which are connected in assembly with elongated brush supporting bodies which support wire brush elements for performing a cleaning and scraping action on the casing wall. The assembly of scraper or wiper flanges and scraper brushes is adapted to be pumped down the casing by pressure fluid or mechanically traversed through the casing and to reside in the wellbore beyond the interval of interest for production of well fluids. The construction of the well cleaning apparatus is, however, adapted for being drilled out by conventional drilling equipment if necessary.

Those skilled in the art will appreciate the above described advantages and superior features of the present invention together with other important aspects thereof upon reading the detailed description which follows in conjunction with the drawing.

DESCRIPTION OF A PREFERRED EMBODIMENT

Figure 1:
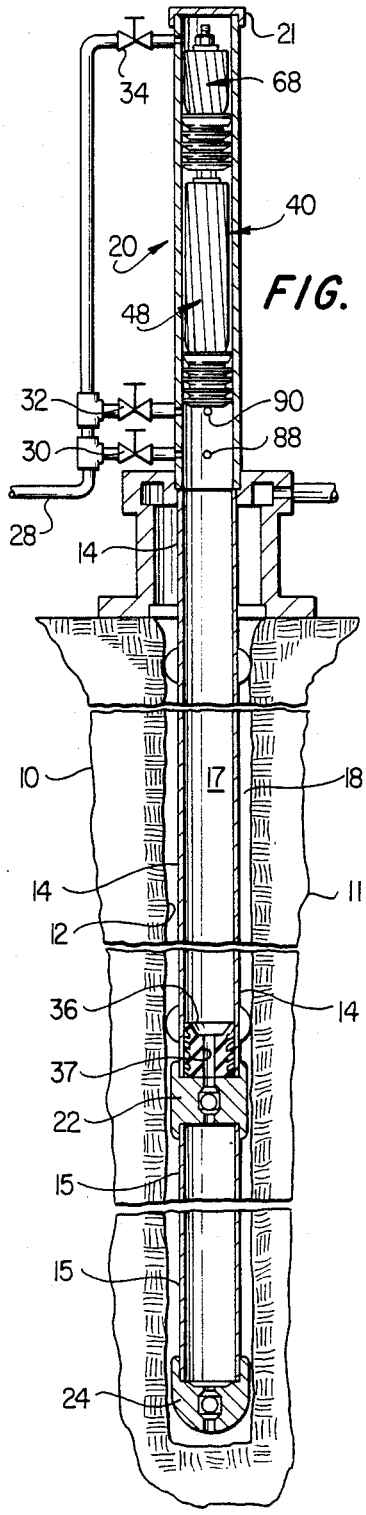
FIG. 1 is a vertical section view in somewhat schematic form of a well which is in readiness for cleaning of the main well casing in accordance with the present invention.

In the description which follows, like parts are marked throughout the specification and drawing with the same reference numerals, respectively. The drawing figures are not necessarily to scale and certain features are shown exaggerated in scale or in somewhat schematic form in the interest of clarity and conciseness.

Referring now to Figure there is illustrated a portion of an earth formation 10 into which a wellbore 12 has been drilled and a casing 14 set in place and connected to a conventional cementing head assembly 20. The annular space 18 between the casing 14 and the wellbore 12 has been prepared to be filled with a hardenable cement composition of a conventional type by injecting the composition through the casing 14 by way of the cementing head 20. The head 20 has been modified to practice the present invention by increasing its effective length for holding the apparatus or system of the present invention prior to implementation of the method of the present invention.

The casing 14 typically includes a check valve member sometimes known as a float collar 22 interposed in the casing below the region of interest of the formation 10, which region of interest is generally designated by the numeral 11. The check valve 22 prevents circulation of wellbore fluids up through the interior of the casing from the bottom thereof. A secondary check valve is disposed in a lower end member of the casing and comprising a casing shoe 24. The check valve in the casing shoe 24 is operable in the same manner as the check valve 22 and provides redundancy in preventing wellbore fluids from entering the casing through the shoe or that portion of the casing string between the check valve 22 and the shoe 24. In accordance with the present invention, two or more forty foot lengths of casing are made up to form the casing portion 15 interposed between the check valves 22 and 24 and which comprises a space for accumulating debris and material desired to be cleaned from the portion of the casing string between the check valve 22 and the head 20. In a conventional cementing operation a slurry-like cement composition is injected into the casing 14 through the head 20 by way of a conduit 28. The cement slurry and other fluids injected into the casing string through the head 20 are controlled by a series of valves 30, 32 and 34 which are interposed in branch conduits interconnecting the head 20 with the conduit 28, as illustrated.

FIG. 1 illustrates the condition in regard to the cementing of the wellbore 12 wherein a so-called bottom plug member 36 has been introduced into the casing 14 through the head 20 to form a spacer between the cement composition which is in the casing 14, occupying the space 17 between the plug 36 and the head 20, in the condition shown. The bottom plug 36 is optionally used and is typically launched from the head 20 in a conventional manner and is of conventional construction. When the column of cement in the space 17 has pumped the bottom plug 36 down to the float collar or check valve 22. A frangible disk, not shown, normally associated with the plug 36 is ruptured under fluid pressure to open the passage 37 to permit the flow of cement composition and other fluid through the check valve 22 into the casing section 15.

Figure 2:
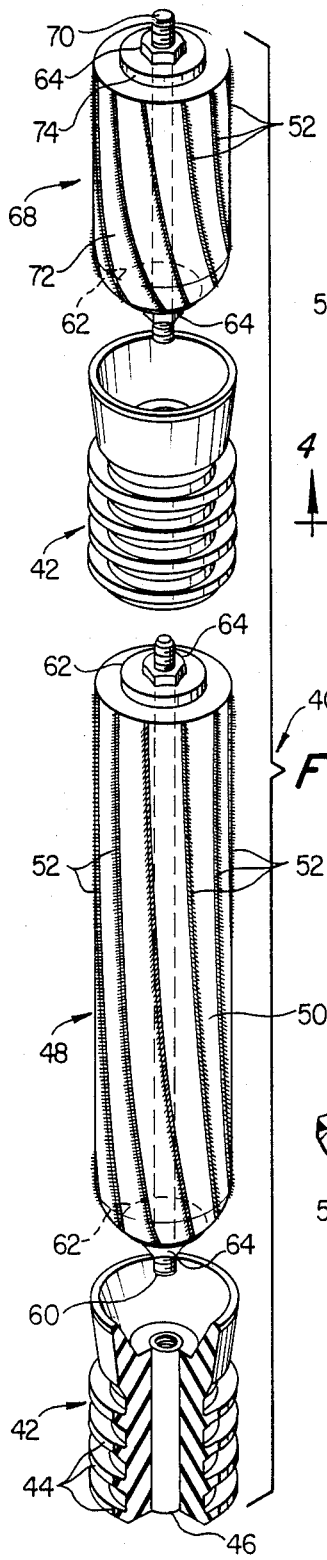
FIG. 2 is an exploded perspective view of the cleaning apparatus of the present invention.

As previously mentioned, the condition of the well illustrated in Figure is that in which the casing cleaning apparatus or system of the present invention is disposed in the head 20 and is ready to be launched into the casing 14 to displace the cement composition from the space 17 into the annular space 18 and to simultaneously clean the interior walls of the casing section 14 until the apparatus engages the plug 36. Referring to FIG. 2 also, the casing cleaning apparatus or system is illustrated in an exploded or disassembled condition and generally designated by the numeral 40. The apparatus 40 is preferably made up of a conventional oil well cementing top plug member 42 which is a member having a plurality of circumferential flange portions 44, is made of a relatively hard but deformable rubber or rubber-like material and has a metal cylindrical core piece 46 which is provided with opposed internal, axially extending threads for coupling the plug to another portion of the apparatus 40.

Figure 3:
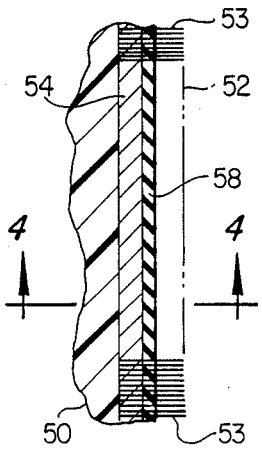
FIG. 3 is a detail longitudinal section view of a portion of one of the scraper brush support bodies.
Figure 4:
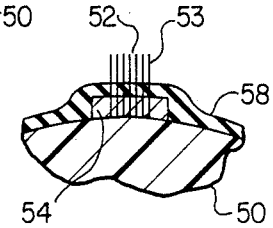
FIG. 4 is a detail transverse section view taken from the line 4—4 of FIG. 3.

As further illustrated in FIG. 2, the apparatus 40 also includes an elongated cylindrical brush member 48 comprising a generally cylindrical body 50 formed of a nonrigid polyurethane foam, preferably in the eight to ten pound per cubic foot density range, and having formed on its exterior surface, helical strips or wraps of wire bristles, each wrap generally designated by the numeral 52. The brush strips or wraps 52 are preferably spaced apart equally one from the other around the circumference of the body 50. The bristles 53 of each wrap 52 are approximately 0.250 inches in effective or free radial height with respect to the longitudinal central axis of the body 50 and, as shown in FIGS. 3 and 4, are mounted on a suitable backing 54 secured to the body 50. The brush strips or wraps 52 are further supported on the body 50 by a 70 to 80 durometer polyurethane rubber coating 58 approximately 0.10 inches thick. The wire brush bristles 53 are preferably of flame hardened steel. The overall diameter of the member 48 including the bristles 53 is preferably approximately 3% greater than the inside diameter of the casing section to be traversed by the apparatus 40. The body 50 of the brush member 48 also has extending therethrough an elongated threaded aluminum rod 60 which is secured to the body at opposite ends by opposed aluminum washers 62 and threaded nut members 64. A portion of the rod 60 extends beyond the respective nut members 64 and provides for threadedly connecting the brush member 48 to a plug member 42 at the lower end and to an intermediate plug member 42.

A second brush member 68 is provided which has the same general features as the brush member 48, but is typically of shorter length. The brush member 68 also has plural helical wraps 52 of pipe scraping wire bristles 53 and is constructed in the same manner as the brush member 48. The brush member 68 also includes an elongated central aluminum rod 70 which is secured to the body 72 of the brush member 68 by opposed washers 62 and 74 which are secured to the body member 72 by nuts 64. The washer member 74 is preferably only slightly less in diameter than the body 72 so that it provides a rigid surface for engagement with the lower end of a drill pipe or the like in the event it is necessary to mechanically push the apparatus 40 through the casing instead of relying on the urging of pressure fluid to propel the apparatus through the casing.

As shown in FIG. 1, the apparatus 40 may be inserted in the head 20 through the upper end by way of a removable cap 21 and is held for release by conventional mechanism, not shown, but including a retractable pin 90. The head 20 may, in fact, be similar in construction to that disclosed in U.S. Pat. No. 4,427,065 to James S. Watson but modified to increase its overall length above the release point for the top cementing plug. Thanks to the helical arrangement of the brush wraps 52 on each of the brush members 48 and 68 and the scraping action of the flanges of the plugs 42, the casing walls are scraped clean and free of debris, cement slurry and other material as the apparatus is pumped down through the casing string until it engages the plug 36. The accumulated debris, scraped free from the wall surface of the casing 14, is pushed ahead of the apparatus 40 as it traverses the casing and eventually is displaced into the casing section 15 where it remains. Material which is not pushed ahead of the apparatus 40 as it progresses down through the casing 14 is nevertheless freed from adherence to the inside wall of the casing 14 and may easily be flushed down into the section of the casing below the region of interest 11 by the fluid which displaces the apparatus 40 during the cement displacement and casing cleaning operation.

Although those skilled in the art may easily understand the use of the apparatus 40 from the foregoing description, a referred method of cleaning a well casing with the apparatus 40 will now be described. Prior to cementing the space 18 or any portion thereof, typically the plug 36 and the apparatus 40 are loaded into the interior of the head 20 and the cover 21 placed thereon to close the upper end of the head. The plug 36 is typically retained in the head 20 just below the lower plug 42 of the apparatus 40 by a suitable mechanism such as a retractable retaining pin 88. In like manner, the apparatus 40 is also preferably retained in the position illustrated in FIG. 1 by the retractable retaining pin 90. Prior to launching the plug 36 down through the casing, a preflush treatment or the like may be carried out by injecting certain fluids through the conduit 28 and the valve 30 into the space 17 below the plug 36. When it is desired to commence filling the wellbore space 17 with cement composition the valve 30 is closed as well as the valve 34 and the valve 32 is opened while the conduit 28 is placed in communication with a source of flowable cement slurry, not shown. This slurry is then pumped into the head 20 while the plug 36 is released by retracting the pin 88 so that the plug 36 precedes the column of cement into the space 17 as the plug traverses down the casing 14. When the plug 36 has engaged the check valve 22, the pressure of the cement composition being pumped into the space 17 is increased until the aforementioned frangible disk ruptures to open the passage 36 whereby cement is allowed to pass through the check valve or float collar 22, the shoe 24 and into the space 18.

When the quantity of cement desired to be displaced into the space 18 has been pumped into the space 17, the valve 32 is closed, the conduit 28 suitably flushed and a source of displacement fluid, not shown, is placed in communication with the conduit. The valve 34 is then opened while the valves 30 and 32 are maintained in a closed condition and the pin 90 is retracted to allow the apparatus 40 to be displaced downward through the casing string under the urging of pressure fluid acting on the transverse upper end face of the body 72 and the washer 74. As the column of cement composition is displaced from the space 17 while the apparatus 40 is pumped down the casing string the wire bristle wraps 52 thoroughly scrape and clean the interior surface of the casing along with the scraping and cleaning action of the flanges 44 of the plugs 42 and the accumulation of debris, cement material, drilling fluid, pipe composition and so forth is pushed ahead of the apparatus 40, through the passage 37 and into the casing string section 15. In particular, the bulk of the debris scraped by the brush members 48 and 68 is pushed ahead of the apparatus 40 and, nevertheless, is freed from adherence to the inside wall of the casing 14. The displacement fluid urging the apparatus 40 downward thus flushes and carries any debris which is not pushed ahead of the apparatus down into the casing below the region of interest where it remains out of the way and does not interfere with further well completion and formation stimulation operations. Thanks to the interference fit between the brush members 48 and 68 and the bore of the casing string, a thorough cleaning and scraping action occurs as the apparatus 40 is pumped down the casing. In the event that the apparatus 40 cannot be pumped down the casing string, the cap 21 may be removed and the apparatus forcibly engaged by a tubing string or the like to push it under mechanical force down through the casing to the desired point which is, typically, in engagement with the plug 36. Accordingly, substantially all of the debris and unwanted material which has accumulated on the inside wall of the casing 14, generally above the float collar 22, is cleaned in one continuous operation which is preferably carried out simultaneously with displacement of cement into a space to be cemented as described. Those skilled in the art will recognize that the apparatus 40 may, however, be traversed through the casing 14 at other times for the purpose of cleaning the casing inside wall. Moreover, the apparatus 40 is conveniently constructed of easily drillable materials whereby a conventional drill bit or milling tool may be deployed into the casing to "drill out" the casing cleaning apparatus.

Although a preferred embodiment of a method and apparatus or system in accordance with the present invention has been described herein, those skilled in the art will recognize that various substitutions and modifications may be made to the invention without departing from the scope and spirit thereof as recited in the appended claims.

What is claimed is:

1. Apparatus for cleaning the interior wall of a well casing string and the like comprising:

an elongated generally cylindrical body member formed of a resilient plastic material;

a plurality of elongated helical wraps of wire bristles disposed on the exterior surface of said body member and projecting generally radially outwardly with respect to a longitudinal central axis of said body member, said wire bristles having a free radial height with respect to said longitudinal central axis of said body member of about 0.25 inches and the outer diameter of said wraps of said wire bristles being at least about 3% greater than the diameter of the inside wall of said casing;

elongated rod means extending completely through said body member, said rod means including thread means thereon for connecting said body member to a plug member; and a plug member formed of deformable rubberlike material having read means therein for connection to said thread means of the rod means of said body member and having plural cylindrical flanges engageable with said wall of said casing and forming a generally fluid tight seal therewith.

2. The apparatus set forth in claim 1 including:

substantially rigid disk means supported on said body member at one transverse end thereof for engagement by means for propelling said body member through said casing.

3. The apparatus set forth in claim 1 wherein:

said apparatus includes at least two body members having wire bristles formed thereon for engagement with said casing wall, said body members being connected to a plug member interposed between said body members, respectively.

4. Apparatus for cleaning the interior wall of a well casing string and the like comprising:

a first elongated generally cylindrical body member formed of a resilient plastic material, said first body member including a plurality of elongated helical wraps of wire bristles disposed on the exterior surface of said first body member and projecting generally radially outwardly with respect to a longitudinal central axis of said first body member, said wire bristles having a free radial height with respect to said longitudinal central axis of about .25 inches and the outer diameter of said wraps of said wire bristles being greater than the diameter of the inside wall of said casing;

elongated rod means extending completely through said first body member and including thread means thereon for connecting said first body member to a first plug member;

a first plug member formed of deformable rubber-like material having thread means therein for connection to said thread means of the rod means of said first body member and having plural cylindrical flanges engageable with said wall of said casing and forming a generally fluid tight seal therewith;

a second plug member connected to said first body member at an end of said first body member opposite said first plug member, said second plug member being formed of a deformable rubberlike material and having a plurality of cylindrical flanges engageable with said wall of said casing to form a substantially fluid tight seal therewith; and a second elongated generally cylindrical body member connected to said second plug member and formed of a resilient plastic material and including a plurality of elongated helical wraps of wire bristles disposed on the exterior surface of said second body member and projecting generally radially outwardly with respect to a longitudinal central axis of said second body member, said wire bristles on said second body member having a free radial height with respect to said longitudinal central axis of said second body member of about 0.25 inches and the outer diameter of said wraps of said wire bristles on said second body member being greater than the diameter of said inside wall of said casing.

* * * * *